US005605750A

United States Patent [19]

Romano et al.

[11] Patent Number: 5,605,750

[45] Date of Patent: Feb. 25, 1997

[54] MICROPOROUS INK-JET RECORDING ELEMENTS

[75] Inventors: Charles E. Romano; Douglas E. Bugner, both of Rochester; Wayne T. Ferrar, Fairport, all of N.Y.

[73] Assignee: Eastman Kodak Company, Rochester, N.Y.

[21] Appl. No.: 580,698

[22] Filed: Dec. 29, 1995

[51] Int. Cl.[6] ..... B41M 5/00

[52] U.S. Cl. ..... 428/304.4; 428/195; 428/331; 428/500; 428/532

[58] Field of Search ..... 428/195, 304.4, 428/331, 500, 532

[56] References Cited

U.S. PATENT DOCUMENTS

| | | | |
|---|---|---|---|
| 5,104,730 | 4/1992 | Misuda et al. | 428/304.4 |
| 5,264,275 | 11/1993 | Misuda et al. | 428/304.4 |
| 5,354,634 | 10/1994 | Misuda et al. | 430/18 |
| 5,463,178 | 10/1995 | Suzuki et al. | 428/216 |

FOREIGN PATENT DOCUMENTS

| | | |
|---|---|---|
| 0507255A1 | 10/1992 | European Pat. Off. . |
| 0634287A1 | 1/1995 | European Pat. Off. . |
| 2276670 | 11/1990 | Japan . |
| 3143678 | 6/1991 | Japan . |
| 3215082 | 9/1991 | Japan . |
| 4115984 | 4/1992 | Japan . |
| 4263982 | 9/1992 | Japan . |
| 4263983 | 9/1992 | Japan . |
| 4320877 | 11/1992 | Japan . |
| 5024335 | 2/1993 | Japan . |
| 5024336 | 2/1993 | Japan . |
| 5032037 | 2/1993 | Japan . |
| 6262844 | 9/1994 | Japan . |
| 6270530 | 9/1994 | Japan . |
| 6297831 | 10/1994 | Japan . |
| 95002430 | 1/1995 | Japan . |

*Primary Examiner*—Pamela R. Schwartz
*Attorney, Agent, or Firm*—John R. Everett

[57] ABSTRACT

An opaque image-recording element for an ink-jet printer which comprises an opaque substrate having on at least one surface thereof a lower layer of a solvent-absorbing microporous material which comprises:

(a) a matrix of substantially water-insoluble thermoplastic organic polymer;

(b) finely divided substantially water-insoluble filler particles, of which at least 50 percent by weight are siliceous particles, the filler particles being distributed throughout the matrix and constituting from 40 to 90 percent by weight of the microporous material;

(c) a network of interconnecting pores communicating substantially throughout the microporous material, the pores constituting from 35 to 95 percent by volume of the microporous material, and an upper image-forming layer of porous, pseudo-boehmite having an average pore radius of from 10 to 80 Å.

17 Claims, No Drawings

MICROPOROUS INK-JET RECORDING ELEMENTS

BACKGROUND OF THE INVENTION

1. Field of the Invention

The present invention relates generally to an opaque image-recording element and, more particularly, the present invention relates to a recording element for an automated printing assembly such as a computer-driven ink-jet printer having excellent ink-receiving properties.

2. Description of the Related Art

In a typical ink-jet recording or printing system, ink droplets are ejected from a nozzle at high speed towards a recording element or medium to produce an image on the medium. The ink droplets, or recording liquid, generally comprise a recording agent, such as a dye, and a large amount of solvent in order to prevent clogging of the nozzle. The solvent, or carrier liquid, typically is made up of water, an organic material such as a monohydric alcohol or a polyhydric alcohol or a mixed solvent of water and other water miscible solvents such as a monohydric alcohol or a polyhydric alcohol.

The recording elements or media typically comprise a substrate or a support material having on at least one surface thereof an ink-receiving or image-forming layer. The elements include those intended for reflection viewing, which usually have an opaque support, and those intended for viewing by transmitted light, which usually have a transparent support.

While a wide variety of different types of image-recording elements have been proposed heretofore, there are many unsolved problems in the art and many deficiencies in the known products which have severely limited their commercial usefulness. The requirements for an image-recording medium or element for ink-jet recording are very demanding. For example, the recording element must be capable of absorbing or receiving large amounts of ink applied to the image-forming surface of the element as rapidly as possible in order to produce recorded images having high optical density and good color gaumet.

One example of an opaque image-recording element is described in U.S. Pat No. 5,326,391. It consists of a layer of a microporous material which comprises a matrix consisting essentially of a substantially water-insoluble thermoplastic organic polymer, such as a linear ultra-high molecular weight polyethylene, a large proportion of finely divided water-insoluble filler of which at least about 50 percent by weight is siliceous and interconnecting pores. The porous nature of the image-recording element disclosed in U.S. Pat. No. 5,326,391 allows inks to penetrate the surface of the element to produce text and/or graphic images. However, the images produced on these elements have been found to be of poor quality, i.e., the images have low optical densities and poor color gamut. Thus, it can be seen that a need still exists in the art for the provision of an opaque image-recording element suitable for use in an ink-jet printer which is capable of recording images (including color images) having high optical densities and good color gamut. It is towards fulfilling these needs that the present invention is directed.

SUMMARY OF THE INVENTION

In accordance with the present invention, there is provided an opaque recording element for use in an ink-jet printer which comprises an opaque substrate having on at least one surface thereof a lower layer of a solvent-absorbing microporous material which comprises:

(a) a matrix of substantially water-insoluble thermoplastic organic polymer;

(b) finely divided substantially water-insoluble filler particles, of which at least 50 percent by weight are siliceous particles, said filler particles being distributed throughout said matrix and constituting from 40 to 90 percent by weight of said microporous material;

(c) a network of interconnecting pores communicating substantially throughout said microporous material, said pores constituting from 35 to 95 percent by volume of said microporous material, and an upper image-forming layer of porous pseudo-boehmite having an average pore radius of from 10 to 80 Å.

DESCRIPTION OF THE PREFERRED EMBODIMENTS

The recording elements of the present invention generally comprise an opaque substrate as a supporting member, a layer of microporous material coated over at least a portion of at least one surface of the substrate and an image-forming layer coated over the microporous material.

The supports or substrates used in the recording elements of the present invention arc opaque substrates and may include, for example, ordinary plain papers, resin-coated papers, cloth, wood, metal plates, opaque films and otherwise transparent substrates such as, for example, films or sheets of polyester resins, diacetate resins, triacetate resins, acrylic resins, polycarbonate resins, polyvinyl chloride resins, polyimide resins, Cellophane (brand name) and Celluloid (brand name) that have been rendered opaque by converting the transparent substrate into an opaque substrate in accordance with known methods such as by adding fillers such as silica, alumina, titania, calcium carbonate, barium carbonate or the like to the transparent substrate to render it opaque.

In addition, the substrates employed in the recording elements of the present invention must be self-supporting. By "self-supporting" is meant a support material such as a sheet or film that is capable of independent existence in the absence of a supporting substrate. The support is suitably of a thickness of from about 50 to 500 micrometers, preferably from about 75 to 300 micrometers. Antioxidants, antistatic agents, plasticizers and other known additives may be incorporated into the supports.

If desired, in order to improve the adhesion of the solvent-absorbing layer to the substrate, the surface of the substrate may be corona-discharge-treated prior to applying the solvent-absorbing layer to the substrate or, alternatively, an under-coating, such as a layer formed from a halogenated phenol or a partially hydrolyzed vinyl chloride-vinyl acetate copolymer can be applied to the surface of the substrate. If an under-coating or subbing layer is used, it should have a thickness (i.e., a dry coat thickness) of less than 2 micrometers.

Optionally, an additional backing layer or coating may be applied to the backside of the substrate (i.e., the side of the substrate opposite the side on which the solvent-absorbing layer and the porous pseudo-boehmite layer are formed) for the purposes of improving the machine-handling properties of the recording element, controlling the friction and resistivity thereof, and the like. Typically, the backing layer may comprise a binder and a filler. Typical fillers include amorphous and crystalline silicas, poly(methyl methyacrylate), hollow sphere polystyrene beads, micro crystalline cellulose, zinc oxide, talc, and the like. The filler loaded in the backing layer is generally less than 2 percent by weight of the binder component and the average particle size of the filler material is in the range of 5 to 15, preferably 5 to 10 micrometers. Typical of the binders used in the backing layer are polymers such as acrylates, methacrylates, polystyrenes, acrylamides, poly(vinyl chloride)-poly(vinyl acetate) co-polymers, poly(vinyl alcohol), SBR latex, NBR latex, cellulose derivatives, and the like. Additionally, an antistatic agent also can be included in the backing layer to prevent static hindrance of the recording element. Particularly suitable antistatic agents are compounds such as dodecylbenzenesulfonate sodium salt, octylsulfonate potassium salt, oligostyrenesulfonate sodium salt, laurylsulfosuccinate sodium salt, and the like. The antistatic agent is added to the binder composition in an amount of 0.1 to 15 percent by weight, based on the weight of the binder.

On the substrate, a layer of microporous material capable of absorbing the solvent carrier in the ink is formed. The thickness of this layer is from 1 to 18 mils, preferably 2 to 12 mils. If the thickness of the solvent-absorbing layer is less than 1 mil, adequate absorption of the solvent will not be obtained. On the other hand, if the thickness of the solvent-absorbing layer exceeds about 18 mils, no further increase in solvent absorptivity will be gained.

The microporous material comprises: (a) a matrix of thermoplastic organic polymer; (b) a large proportion of finely divided water-insoluble siliceous filler, and (c) interconnecting pores. More specifically, the microporous material comprises: (a) a matrix of substantially water-insoluble thermoplastic organic polymer; (b) finely divided substantially water-insoluble filler particles, of which at least 50 percent by weight are siliceous particles, the filler particles being distributed throughout the matrix and constituting from 40 to 90 percent by weight of the microporous material, and (c) a network of interconnecting pores communicating substantially throughout the microporous material, the pores constituting from 35 to 95 percent by volume of the microporous material.

Many known microporous materials may be employed in the recording elements of the present invention. Examples of such microporous materials, processes for making such microporous materials, and their properties are described in U.S. Pat. Nos. 2,772,322; 3,351,495; 3,696,061; 3,725,520; 3,862,030; 3,903,234; 3,967,978; 4,024,323; 4,102,746; 4,169,014; 4,210,709; 4,226,926; 4,237,083; 4,335,193; 4,350,655; 4,472,328; 4,585,604; 4,613,643; 4,681,750; 4,791,144; 4,833,172; 4,861,644; 4,892,779; 4,927,802; 4,872,779; 4,927,802; 4,937,115; 4,957,787; 4,959,208; 5,032,450; 5,035,886; 5,071,645; 5,047,283; and 5,114,438.

The matrix of the microporous material consists of substantially water-insoluble thermoplastic organic polymer. The numbers and kinds of such polymers suitable for use of the matrix are enormous. In general, substantially any substantially water-insoluble thermoplastic organic polymer which can be extruded, calandared, pressed, or rolled into film, sheet, strip, or web may be used. The polymer may be a single polymer or it may be a mixture of polymers. The polymers may be homopolymers, copolymers, random copolymers, block copolymers, graft copolymers, atactic polymers, isotactic polymers, syndiotactic polymers, linear polymers, or branched polymers. When mixtures of polymers are used, the mixture may be homogeneous or it may comprise two or more polymeric phases. Examples of classes of suitable substantially water-insoluble thermoplastic organic polymers include the thermoplastic polyolefins, poly(halo-substituted olefins), polyesters, polyamides, polyurethanes, polyureas, poly(vinyl halides), poly(vinylidene halides), polystyrenes, poly(vinyl esters), polycarbonates, polyethers, polysulfides, polyimides, polysilanes, polysiloxanes, polycaprolactones, polyacrylates, and polymethacrylates. Hybrid classes exemplified by the thermoplastic poly(urethane-ureas), poly(ester-amides), poly(silane-siloxanes), and poly(ether-esters) are within contemplation. Examples of suitable substantially water-insoluble thermoplastic organic polymers include thermoplastic high density polyethylene, low density polyethylene, ultrahigh molecular weight polyethylene, polypropylene (atactic, isotactic, or syndiotatic as the case may be), poly(vinyl chloride), polytetrafluoroethylene, copolymers of ethylene and acrylic acid, copolymers of ethylene and methacrylic acid, poly(vinylidene chloride), copolymers of vinylidene chloride and vinyl acetate, copolymers of vinylidene chloride and vinyl chloride, copolymers of ethylene and propylene, copolymers of ethylene and butene, poly(vinyl acetate), polystyrene, (poly(omega-aminoundecanoic acid), poly(hexamethylene adipamide), poly(epsilon-caprolactam), and poly(methyl methacrylate). These listings are by no means exhaustive, but are intended for purposes of illustration. The preferred substantially water-insoluble thermoplastic organic polymers comprise poly(vinyl chloride), copolymers of vinyl chloride, or mixtures thereof; or they comprise essentially linear ultrahigh molecular weight polyolefin which is essentially linear ultrahigh molecular weight polyethylene having an intrinsic viscosity of at least 10 deciliters/gram, essentially linear ultrahigh molecular weight polypropylene having an intrinsic viscosity of at least 6 deciliters/gram, or a mixture thereof. Essentially linear ultrahigh molecular weight polyethylene having an intrinsic viscosity of at least 18 deciliters/gram is especially preferred.

Inasmuch as ultrahigh molecular weight (UHMW) polyolefin is not a thermoset polymer having an infinite molecular weight, it is technically classified as a thermoplastic. However, because the molecules are essentially very long chains, UHMW polyolefin, and especially UHMW polyethylene, softens when heated but does not flow as a molten liquid in a normal thermoplastic manner. The very long chains and the peculiar properties they provide to UHMW polyolefin are believed to contribute in large measure to the desirable properties of microporous materials made using this polymer.

As indicated earlier, the intrinsic viscosity of the UHMW polyethylene is at least 10 deciliters/gram. Usually the intrinsic viscosity is at least 14 deciliters/gram. Often the intrinsic viscosity is at least 18 deciliters/gram. In many cases the intrinsic viscosity is at least 19 deciliters/gram. Although there is no particular restriction on the upper limit of the intrinsic viscosity, the intrinsic viscosity is frequently in the range of from 10 to 39 deciliters/gram. The intrinsic viscosity is often in the range of from 14 to 39 deciliters/gram. In most cases the intrinsic viscosity is in the range of 18 to 39 deciliters/gram. an intrinsic viscosity in the range of from 18 to 32 deciliters/gram is preferred.

Also as indicated earlier the intrinsic viscosity of the UHMW polypropylene is at least 6 deciliters/gram. In many cases the intrinsic viscosity is at least 7 deciliters/gram. Although there is no particular restriction on the upper limit of the intrinsic viscosity, the intrinsic viscosity is often in the range of from 6 to 18 deciliters/gram. An intrinsic viscosity in the range of from 7 to 16 deciliters/gram is preferred.

As used herein and in the claims, intrinsic viscosity is determined by extrapolating to zero concentration the reduced viscosities or the inherent viscosities of several dilute solutions of the UHMW polyolefin where the solvent is freshly distilled decahydronaphthalene to which 0.2 percent by weight, 3,5-di-tert-butyl-4-hydroxyhydrocinnamic acid, neopentanetetrayl ester [CAS Registry No. 6683-19-8]has been added. The reduced viscosities or the inherent viscosities of the UHMW polyolefin are ascertained from relative viscosities obtained at 135° C. using an Ubbelohde No. 1 viscometer in accordance with the general procedures of ASTM D 4020-81, except that several dilute solutions of differing concentration are employed.

The nominal molecular weight of UHMW polyethylene is empirically related to the intrinsic viscosity of the polymer according to the equation:

$$M=5.37\times10^4\ (\eta)^{1.37}$$

where M is the nominal molecular weight and (η) is the intrinsic viscosity of the UHMW polyethylene expressed in deciliters/gram. Similarly, the nominal molecular weight of UHMW polypropylene is empirically related to the intrinsic viscosity of the polymer according to the equation:

$$M=8.88\times10^4\ (\eta)^{1.25}$$

where M is the nominal molecular weight and (η) is the intrinsic viscosity of the UHMW polypropylene expressed in deciliters/gram.

The essentially linear ultrahigh molecular weight polypropylene is most frequently essentially linear ultrahigh molecular weight isotactic polypropylene. Often the degree of isotacicity of such polymer is at least 95 percent, while preferably it is at least 98 percent.

When used, sufficient UHMW polyolefin should be present in the matrix to provide its properties to the microporous material. Other thermoplastic organic polymer may also be present in the matrix so long as its presence does not materially affect the properties of the microporous material in an adverse manner. The amount of the other thermoplastic polymer which may be present depends upon the nature of such polymer. In general, a greater amount of other thermoplastic organic polymer may be used if the molecular structure contains little branching, few long sidechains, and few bulky side groups, than when there is a large amount of branching, many long sidechains, or many bulky side groups. For this reason, the preferred thermoplastic organic polymers which may optionally be present are low density polyethylene, high density polyethylene, poly(tetrafluoroethylene), propylene, copolymers of ethylene and propylene, copolymers of ethylene and acrylic acid, and copolymers of ethylene and methacrylic acid. If desired, all or a portion of the carboxyl groups of carboxyl-containing copolymers may be neutralized with sodium, zinc, or the like. Usually, at least about one percent UHMW polyolefin, based on the weight of the matrix, will provide the desired properties to the microporous material. At least 3 percent UHMW polyolefin by weight of the matrix is commonly used. In many cases at least 10 percent by weight of the matrix is UHMW polyolefin. Frequently, at least 50 percent by weight of the matrix is UHMW polyolefin. In many instances at least 60 percent by weight of the matrix is UHMW polyolefin. Sometimes at least 70 percent by weight of the matrix is UHMW polyolefin. In some cases, the other thermoplastic organic polymer is substantially absent.

A particularly suitable matrix comprises a mixture of substantially linear ultrahigh molecular weight polyethylene having an intrinsic viscosity of at least 10 deciliters/gram and lower molecular weight polyethylene having an ASTM D 1238-86 Condition E melt index of less than 50 grams/10 minutes and an ASTM D 1238-86 Condition F melt index of at least 0.1 gram/10 minutes. The nominal molecular weight of the lower molecular weight polyethylene (LMWPE) is lower than that of the UHMW polyethylene. LMWPE is thermoplastic and many different types are known. One method of classification is by density, expressed in grams/cubic centimeter and rounded to the nearest thousandth, in accordance with ASTM D 1248-84 (Reapproved 1989):

TABLE 1

| Type | Abbreviation | Density, g/cm$^3$ |
|---|---|---|
| Low Density Polyethylene | LDPE | 0.910–0.925 |
| Medium Density Polyethylene | MDPE | 0.926–0.940 |
| High Density Polyethylene | HDPE | 0.941–0.965 |

Any or all of these polyethylenes may be used as the LMWPE in the present invention. HDPE, however, is preferred because it ordinarily tends to be more linear than MDPE or LDPE.

The ASTM D 1238-86 Condition E (that is, 190° C. and 2.16 kilogram load) melt index of the LMWPE is less than 50 grams/10 minutes. Often the Condition E melt index is less than 25 grams/10 minutes. Preferably the Condition E melt index is less than 15 grams/10 minutes.

The ASTM D 1238-86 Condition F (that is, 190° C. and 21.6 kilogram load) melt index of the LMWPE is at least 0.1 gram/10 minutes. In many cases the Condition F melt index is at least 0.5 gram/10 minutes. Preferably the Condition F melt index is at least 1.0 gram/10 minutes.

It is highly desirable that the UHMW polyethylene constitute at least one percent by weight of the matrix and that the UHMW polyethylene and the LFfWPE together constitute substantially 100 percent by weight of the polymer of the matrix.

As present in the microporous material, the finely divided substantially water-insoluble siliceous particles may be in the form of ultimate particles, aggregates of ultimate particles, or a combination of both. In most cases, at least 90 percent by weight of the siliceous particles used in preparing the microporous material have gross particle sizes in the range of from 5 to 40 micrometers as determined by use of a Model TAII Coulter counter (Coulter Electronics, Inc.) according to ASTM C 690-80 but modified by stirring the filler for 10 minutes in Isoton II electrolyte (Curtin Matheson Scientific, Inc.) using a four-blade, 4,445 centimeter diameter propeller stirrer. Preferably, at least 90 percent by weight of the siliceous particles have gross particle sizes in the range of from 10 to 30 micrometers. It is expected that the sizes of filler agglomerates may be reduced during processing of the ingredients to prepare the microporous material. Accordingly, the distribution of gross particle sizes in the microporous material may be smaller than in the raw siliceous filler itself.

Examples of suitable siliceous particles include particles of silica, mica, montmorillonite, kaolinite, asbestos, talc, diatomaceous earth, vermiculite, natural and synthetic zeolites, cement, calcium silicate, aluminum silicate, sodium aluminum silicate, aluminum polysilicate, altunina silica gels, and glass particles. Silica and the clays are the preferred siliceous particles. Of the silicas, precipitated silica, silica gel, or fumed silica is most often used.

In addition to the siliceous particles, finely divided substantially water-insoluble non-siliceous filler particles may also be employed. Examples of such optional non-siliceous filler particles include particles of titanium oxide, iron oxide, copper oxide, zinc oxide, antimony oxide, zirconia, magnesia, alumina, molybdenum disulfide, zinc sulfide, barium sulfate, strontium sulfate, calcium carbonate, magnesium carbonate, magnesium hydroxide, and finely divided substantially water-insoluble flame retardant filler particles such as particles of ethylenebis(tetra-bromophthalimide), octabromodiphenyl oxide, decabromodiphenyl oxide, and ethylenebisdibromonorbornane dicarboximide.

As present in the microporous material, the finely divided substantially water-insoluble non-siliceous filler particles may be in the form of ultimate particles, aggregates of ultimate particles, or a combination of both. In most cases, at least 75 percent by weight of the non-siliceous filler particles used in preparing the microporous material have gross particle sizes in the range of from 0.1 to 40 micrometers as determined by use of a Micromeretics Sedigraph 5000-D (Micromeretics Instrument Corp.) in accordance with the accompanying operating manual. The preferred ranges vary from filler to filler. For example, it is preferred that at least 75 percent by weight of antimony oxide particles be in the range of from 0.1 to 3 micrometers, whereas it is preferred that at least 75 percent by weight of barium sulfate particles be in the range of from 1 to 25 micrometers. It is expected that the sizes of filler agglomerates may be reduced during processing of the ingredients to prepare the microporous material. Therefore, the distribution of gross particle sizes in the microporous material may be smaller than in the raw non-siliceous filler itself.

The particularly preferred finely divided substantially water-insoluble siliceous filler particles are precipitated silica. Although both are silicas, it is important to distinguish precipitated silica from silica gel inasmuch as these different materials have different properties. Reference in this regard is made to R. K. Iler, *The Chemistry of Silica*, John Wiley & Sons, New York (1979), Library of Congress Catalog No. QD 181.S6144. Note especially pages 15–29, 172–176, 218–233, 364–365, 462–465, 554–564 and 578–579. Silica gel is usually produced commercially at low pH by acidifying an aqueous solution of a soluble metal silicate, typically sodium silicate, with acid. The acid employed is generally a strong mineral acid such as sulfuric acid or hydrochloric acid although carbon dioxide is sometimes used. Inasmuch as there is essentially no difference in density between the gel phase and the surrounding liquid phase while the viscosity is low, the gel phase does not settle out, that is to say, it does not precipitate. Silica gel then may be described as a nonprecipitated, coherent, rigid, three-dimensional network of contiguous particles of colloidal amorphous silica. The state of subdivision ranges from large, solid masses to submicroscopic particles, and the degree of hydration from almost anhydrous silica to soft gelatinous masses containing on the order of 100 parts of water per part of silica by weight, although the highly hydrated forms are only rarely used in the present invention.

Precipitated silica is usually produced commercially by combining an aqueous solution of a soluble metal silicate, ordinarily alkali metal silicate such as sodium silicate, and an acid so that colloidal particles will grow in weakly alkaline solution and be coagulated by the alkali metal ions of the resulting soluble alkali metal salt. Various acids may be used, including the mineral acids and carbon dioxide. In the absence of a coagulant, silica is not precipitated from solution at any pH. The coagulant used to effect precipitation may be the soluble alkali metal salt produced during formation of the colloidal silica particles, it may be added electrolyte such as a soluble inorganic or organic salt, or it may be a combination of both.

Precipitated silica, then, may be described as precipitated aggregates of ultimate particles of colloidal amorphous silica that have not at any point existed as macroscopic gel during the preparation. The sizes of the aggregates and the degree of hydration may vary widely.

Precipitated silica powders differ from silica gels that have been pulverized in ordinarily having a more open structure, that is, a higher specific pore volume. However, the specific surface area of precipitated silica as measured by the Brunauer, Emmet, Teller (BET) method using nitrogen as the adsorbate, is often lower than that of silica gel.

Many different precipitated silicas may be employed in the present invention, but the preferred precipitated silicas are those obtained by precipitation from an aqueous solution of sodium silicate using a suitable acid such as sulfuric acid, hydrochloric acid, or carbon dioxide. Such precipitated silicas are themselves known and exemplary processes for producing them are described in detail in U.S. Pat. Nos. 2,657,149; 2,940,830; 4,681,750 and 5,094,829.

In the case of the preferred filler, precipitated silica, the average ultimate particle size (irrespective of whether or not the ultimate particles are agglomerated) is less than 0.1 micrometer as determined by transmission electron microscopy. Often the average ultimate particle size is less than 0.05 micrometer. Preferably the average ultimate particle size of the precipitated silica is less than 0.03 micrometer.

The finely divided substantially water-insoluble filler particles constitute from 40 to 90 percent by weight of the microporous material. Frequently such filler particles constitute from 40 to 85 percent by weight of the microporous material. Often the finely divided substantially water-insoluble filler particles constitute from 50 to 90 percent by weight of the microporous material. In many cases the finely divided substantially water-insoluble filler particles constitute from 50 to 85 percent by weight of the microporous material. From 60 percent to 80 percent by weight is preferred.

At least 50 percent by weight of the finely divided substantially water-insoluble filler particles are finely divided substantially water-insoluble siliceous filler particles. In many cases at least 65 percent by weight of the finely divided substantially water-insoluble filler particles are siliceous. Often at least 75 percent by weight of the finely divided substantially water-insoluble filler particles are siliceous. Frequently at least 85 percent by weight of the finely divided substantially water-insoluble filler particles are siliceous. In many instances all of the finely divided substantially water-insoluble filler particles are siliceous.

Minor amounts, usually less than 5 percent by weight, of other materials used in processing such as lubricant, processing plasticizer, organic extraction liquid, water and the like, may optionally also be present. Yet other materials introduced for particular purposes may optionally be present in the microporous material in small amounts, usually less than 15 percent by weight. Examples of such materials include matting agents such as titanium dioxide, zinc oxide and polymeric beads such as crosslinked poly(methyl methacrylate) or polystyrene beads for the purposes of contributing to the non-blocking characteristics of the recording elements used in the present invention and to control the smudge resistance thereof; surfactants such as non-ionic, hydrocarbon or fluorocarbon surfactants or cationic surfactants, such as quaternary ammonium salts for the purpose of improving the aging behavior of the solvent-absorbing layer and enhancing the surface uniformity of the layer; pH controllers; preservatives; viscosity; modifiers; dispensing agents; antioxidants; ultraviolet light absorbers; reinforcing fibers such as chopped glass fiber strand; dyes; pigments; optical brighteners; antistatic agents, and the like. The balance of the microporous material, exclusive of filler, is essentially the thermoplastic organic polymer.

The pores constitute from 35 to 80 percent by volume of the microporous material when made by the above-described process. In many cases the pores constitute from 60 to 75 percent by volume of the microporous material. As used herein, the porosity (also known as void volume) of the microporous material, expressed as percent by volume, is determined according to the equation:

$$\text{Porosity}=100[1-d_1/d_2]$$

where $d_1$ is the density of the sample which is determined from the sample weight and the sample volume as ascertained from measurements of the sample dimensions and $d_2$ is the density of the solid portion of the sample which is determined from the sample weight and the volume of the solid portion of the sample. The volume of the solid portion of the same is determined using a Quantachrome stereopycnometer (Quantachrome Corp.) in accordance with the accompanying operating manual.

The volume average diameter of the pores of the microporous material is determined by mercury porosimetry using an Autoscan mercury porosimeter (Quantrachrome Corp.) in accordance with the accompanying operating manual. The volume average pore radius for a single scan is automatically determined by the porosimeter. In operating the porosimeter, a scan is made in the high pressure range (from about 138 kilopascals absolute to about 227 megapascals absolute). If about 2 percent or less of the total intruded volume occurs at the low end (from about 138 to about 250 kilopascals absolute) of the high pressure range, the volume average pore diameter is taken as twice the volume average pore radius determined by the porosimeter. Otherwise an additional scan is made in the low pressure range (from about 7 to about 165 kilopascals absolute) and the volume average pore diameter is calculated according to the equation:

$$d=2\left[\frac{v_1r_1}{w_1}+\frac{v_2r_2}{w_2}\right]/\left[\frac{v_1}{w_1}+\frac{v_2}{w_2}\right]$$

where d is the volume average pore diameter, $v_1$ is the total volume of mercury intruded in the high pressure range, $v_2$ is the total volume of mercury intruded in the low pressure range, $r_1$ is the volume average pore radius determined from the high pressure scan, $r_2$ is the volume average pore radius determined from the low pressure scan, $w_1$ is the weight of the sample subjected to the high pressure scan, and $w_2$ is the weight of the sample subjected to the low pressure scan. Generally, the volume average diameter of the pores is in the range of from 0.02 to 0.5 micrometer. Very often the volume average diameter of the pores is in the range of from 0.04 to 0.3 micrometer. From 0.05 to 0.25 micrometer is preferred.

In the course of determining the volume average pore diameter by the above procedure, the maximum pore radius can be detected. This is taken from the low pressure range scan if run; otherwise it is taken from the high pressure range scan. The maximum pore diameter is twice the maximum pore radius.

Inasmuch as some coating processes, recording processes, impregnation processes and bonding processes result in filling at least some of the pores of the microporous material and since some of these processes irreversibly compress the microporous material, the parameters in respect of porosity, volume average diameter of the pores, and maximum pore diameter are determined for the microporous material prior to application of one or more of these processes.

Many process are known for producing the microporous materials which may be employed in the present invention. Such processes are exemplified by those described in the patents earlier referenced.

Preferably filler particles, thermoplastic organic polymer powder, processing plasticizer and minor amounts of lubricant and antioxidant are mixed until a substantially uniform mixture is obtained. The weight ratio of filler to polymer powder employed in forming the mixture is essentially the same as that of the microporous material to be produced. The mixture, together with additional processing plasticizer, is introduced to the heated barrel of a screw extruder. Attached to the extruder is a sheeting die. A continuous sheet formed by the die is forwarded without drawing to a pair of heated calender rolls acting cooperatively to form a continuous sheet of lesser thickness than the continuous sheet exiting from the die. The continuous sheet from the calender then passes to a first extraction zone where the processing plasticizer is substantially removed by extraction with an organic liquid which is a good solvent for the processing plasticizer, a poor solvent for the organic polymer and more volatile than the processing plasticizer. Usually, but not necessarily, both the processing plasticizer and the organic extraction liquid are substantially immiscible with water. The continuous sheet then passes to a second extraction zone where the residual organic extraction liquid is substantially removed by steam and/or water. The continuous sheet is then passed through a forced air dryer for substantial removal of residual water and remaining residual organic extraction liquid. From the dryer the continuous sheet, which is microporous material, is passed to a take-up roll.

The processing plasticizer has little solvating effect on the thermoplastic organic polymer at 60° C., only a moderate solvating effect at elevated temperatures on the order of 100° C., and a significant solvating effect at elevated temperatures on the order of 200° C. It is a liquid at room temperature and usually it is processing oil such as paraffinic oil, naphthenic oil, or aromatic oil. Suitable processing oils include those meeting the requirements of ASTM D 2226-82, Types 103 and 104. Preferred are oils which have a pour point of less than 22° C. according to ASTM D 97-66 (reapproved 1978). Particularly preferred are oils having a pour point of less than 10° C. Examples of suitable oils include Shellflex 412® and Shellflex 371® oil (Shell Oil Co.) which are solvent refined and hydrotreated oils derived from naphthenic crude. Further examples of suitable oils include ARCOprime® 400 oil (Atlantic Richfield Co.) and Kaydole® oil (Witco Corp.) which are white mineral oils. It is expected that other materials, including the phthalate ester plasticizers such as dibutyl phthalate, bis(2-ethylhexyl) phthalate, diisodecyl phthalate, dicyclohexyl phthalate, butyl benzyl phthalate, and ditridecyl phthalate will function satisfactorily as processing plasticizers.

There are many organic extraction liquids that can be used. Examples of suitable organic extraction liquids include 1,1,2-trichloroethylene, perchloroethylene, 1,2-dichloroethane, 1,1,1-trichloroethane, 1,1,2-trichloroethane, methylene chloride, chloroform, 1,1,2-trichloro-1,2,2-trifluoroethane, isopropyl alcohol, diethyl ether, acetone, hexane, heptane and toluene.

In the above described process for producing microporous material, extrusion and calendering are facilitated when the substantially water-insoluble filler particles carry much of the processing plasticizer. The capacity of the filler particles to absorb and hold the processing plasticizer is a function of the surface area of the filler. It is therefore preferred that the filler have a high surface area. High surface area fillers are materials of very small particle size, materials having a high degree of porosity or materials exhibiting both characteristics. Usually the surface area of at least the siliceous filler particles is in the range of from 20 to 400 square meters per gram as determined by the Brunauer, Emmett, Teller (BET) method according to ASTM C 819-77 using nitrogen as the adsorbate but modified by outgassing the system and the sample for one hour at 130° C. Preferably, the surface area is in the range of from 25 to 350 square meters per gram. Preferably, but not necessarily, the surface area of any non-siliceous filler particles used is also in at least one of these ranges.

Inasmuch as it is desirable to essentially retain the filler in the microporous material, it is preferred that the substantially water-insoluble filler particles be substantially insoluble in the processing plasticizer and substantially insoluble in the organic extraction liquid when microporous material is produced by the above process.

The residual processing plasticizer content is usually less than 10 percent by weight of the microporous sheet and this may be reduced even further by additional extractions using the same or a different organic extraction liquid. Often the residual processing plasticizer content is less than 5 percent by weight of the microporous sheet and this may be reduced even further by additional extractions.

The pores constitute from 35 to 80 percent by volume of the microporous material when made by the above-described process. In many cases the pores constitute from 60 to 75 percent by volume of the microporous material.

The volume average diameter of the pores of the microporous material when made by the above-described process, is usually in the range of from 0.02 to 0.5 micrometer on a coating-free, recording ink-free, impregnant-free and pre-bonding basis. Frequently the average diameter of the pores is in the range of from 0.04 to 0.3 micrometer. From 0.05 to 0.25 micrometer is preferred.

Microporous material may also be produced according to the general principles and procedures of U.S. Pat. Nos. 2,772,322; 3,696,061; and/or 3,862,030. These principles and procedures are particularly applicable where the polymer of the matrix is or is predominately poly(vinyl chloride) or a copolymer containing a large proportion of polymerized vinyl chloride.

The microporous material produced by the above-described processes may optionally be stretched. It will be appreciated that stretching both increases the void volume of the material and induces regions of molecular orientation. As is well-known in the art, many of the physical properties of molecularly oriented thermoplastic organic polymer, including tensile strength, tensile modulus, Young's modulus, and others, differ considerably from those of the corresponding thermoplastic organic polymer having little or no molecular orientation.

Stretching may be accomplished in a single step or a plurality of steps as desired. For example, when the microporous material is to be stretched in a single direction (uniaxial stretching), the stretching may be accomplished by a single stretching step or a sequence of stretching steps until the desired final stretch ratio is attained. Similarly, when the microporous material is to be stretched in two directions (biaxial stretching), the stretching can be conducted by a single biaxial stretching step or a sequence of biaxial stretching steps until the desired final stretch ratios are attained. Biaxial stretching may also be accomplished by a sequence of one or more uniaxial stretching steps in one direction and one or more uniaxial stretching steps in another direction. Biaxial stretching steps where the microporous material is stretched simultaneously in two directions and uniaxial stretching steps may be conducted in sequence in any order. Stretching in more than two directions is within contemplation. It may be seen that the various permutations of steps are quite numerous. Other steps, such as cooling, heating, sintering, annealing, reeling, unreeling, and the like, may optionally be included in the overall process as desired.

Stretched microporous material may be produced by stretching the unstretched microporous material in at least one stretching direction above the elastic limit. Usually the stretch ratio is at least 1.5. In many cases the stretch ratio is at least 1.7. Preferably it is at least 2. Frequently the stretch ratio is in the range of from 1.5 to 15. Often the stretch ratio is in the range of from 1.7 to 10. Preferably the stretch ratio is in the range of from 2 to 6. As used herein, the stretch ratio is determined by the formula:

$$S=L_2/L_1$$

where S is the stretch ratio, $L_1$ is the distance between two reference points located on the stretched microporous material and on a line parallel to the stretching direction and $L_2$ is the distance between the same two reference points located on the stretched microporous material.

The temperatures at which stretching is accomplished may vary widely. Stretching may be accomplished at ambient room temperature, but usually elevated temperatures are employed. In most cases, the film surface temperatures during stretching are in the range of from 20° C. to 220° C. Often such temperatures are in the range of from 50° C. to 200° C. From 75° C. to 180° C. is preferred.

Various types of stretching apparatus are well-known and may be used to accomplish stretching of the microporous material.

After stretching has been accomplished, the microporous material may optionally be sintered, annealed, heat set and/or otherwise heat treated. During these optional steps, the stretched microporous material is usually held under tension so that it will not markedly shrink at the elevated temperatures employed, although some relaxation amounting to a small fraction of the maxime stretch ratio is frequently permitted.

Following stretching and any heat treatments employed, tension is released from the stretched microporous material after the microporous material has been brought to a temperature at which, except for a small amount of elastic recovery amounting to a small fraction of the stretch ratio, it is substantially dimensionally stable in the absence of tension. Elastic recovery under these conditions usually does not amount to more than 10 percent of the stretch ratio.

Stretching is preferably accomplished after substantial removal of the processing plasticizer as described above. For purposes of this invention, however, the calendered sheet may be stretched in at least one stretching direction followed by substantial removal of the residual organic extraction liquid. It will be appreciated that as stretching may be accomplished in a single step or a plurality of steps, so likewise extraction of the processing plasticizer may be accomplished in a single step or a plurality of steps and removal of the residual organic extraction liquid may be accomplished in a single step or a plurality of steps. The various combinations of the steps stretching, partial stretching, processing plasticizer extraction, partial plasticizer extraction, removal of organic extraction liquid, and partial removal of organic extraction liquid are very numerous, and may be accomplished in any order provided, of course, that a step of processing plasticizer extraction (partial or substantially complete) precedes the first step of residual organic extraction liquid removal (partial or substantially complete). It is expected that varying the orders and numbers of these steps will produce variations in at least some of the physical properties of the stretched microporous product.

In all cases, the porosity of the stretched microporous material is, unless coated, printed, impregnated, or bonded after stretching, greater than that of the unstretched microporous material. On a coating-free, printing ink-free, impregnant-free and pre-bonding basis, pores usually constitute more than 80 percent by volume of the stretched microporous material. In many instances the pores constitute at least 85 percent by volume of the stretched microporous material. Often the pores constitute from more than 80 percent to 95 percent by volume of the stretched microporous material. From 85 percent to 95 percent by volume is preferred.

Generally on a coating-free, printing ink-free, impregnant-free, and pre-bonding basis the volume average diameter of the pores of the stretched microporous material is in the range of from 0.6 to 50 micrometers. Very often the volume average diameter of the pores is in tile range of from 1 to 40 micrometers. From 2 to 30 micrometers is preferred.

Many of the microporous materials used in the recording elements of the present invention are available commercially. One example is a polyethylene polymer-containing material sold by PPG Industries, Inc., Pittsburgh, Pa. under the trade name of Teslin™.

Typically, whether before or after coating the microporous material with an ink-receiving or image-forming layer, the microporous material is bonded or otherwise attached or applied to the substrate by means of conventional techniques. For example, bonding may be accomplished by fusion bonding or adhesive bonding techniques. Examples of fusion bonding include sealing through use of heated rollers, heated bars, heated plates, heated bands, heated wires, flame bonding, radio frequency (RF) sealing, and ultrasonic sealing. Heat sealing is preferred. Solvent bonding may be used where the polymer of the microporous material and/or polymer of the image-forming layer is soluble in the applied solvent at least to the extent that the surface becomes tacky. After the microporous material has been brought into contact with the other layer or sheet, the solvent is removed to form a fusion bond.

Many adhesives which are well-known may be used to accomplish bonding. Examples of suitable classes of adhesives include thermosetting adhesives, thermoplastic adhesive, adhesives which form the bond by solvent evaporation, adhesives which form the bond by evaporation of liquid non-solvents, and pressure sensitive adhesives.

The solvent absorbing layer must be capable of absorbing the solvent contained in the ink.

Typically, the solvent-absorbing microporous material will cover the entire side of one surface of the substrate in the form of a separate and distinct layer. However, there may be instances where it is desirable that the solvent-absorbing material cover only a portion of the substrate as, for example, where it is desired that the solvent-absorbing material adhere to the substrate in the form of one or more spots, patches, strips, bars, etc., or the like. In these instances, the image-forming layer may cover all of the substrate including the solvent-absorbing material or just the solvent-absorbing material itself depending upon the type of effect one wishes to create. In addition, since the microporous material is capable of standing alone, i.e., without having to be adhered to or supported by a substrate, the microporous layer itself can form the substrate for the recording elements of the present invention. In this case, the thickness of the microporous support should be from about 7 to 18 mils.

In the present invention, a porous pseudo-boehmite layer having an average pore radius of from 10 to 80 Å is formed as an upper image-forming layer over the lower solvent-absorbing microporous material layer. The dry thickness of the pseudo-boehmite layer ranges from 0.1 to 20 micrometers, preferably 0.5 to 10 micrometers. If the thickness of this layer is less than 0.1 micrometer, adequate absorptivity of the dye will not be obtained. On the other hand, if the thickness of the layer exceeds about 20 micrometers, the recorded image will possess insufficient gloss and drying time will be increased. Further, if the average pore radius of the pseudo-boehmite layer is less than 10 Å, no adequate absorptivity of the dye in the ink will be obtained. The preferred average pore radius is from 15 to 60 Å. Pore size distribution is measured by a nitrogen adsorption and desorption method. Further, the layer of pseudo-boehmite has a pore volume from 0.1 to 2.0 cc/g, preferably 0.15 to 0.65, from the viewpoint of ink absorptivity.

In the present invention, pseudo-boehmite is a xerogel of boehmite represented by the chemical formula AlOOH. Here, the pore characteristics when gelled vary depending upon the size and shape of colloid particles of boehmite. If boehmite having a large particle size is used, pseudo-boehmite having a large average pore radius can be obtained.

Preferably, an organic binder component is employed in the porous pseudo-boehmite layer to impart mechanical strength to the porous layer. When a binder is employed, the pore characteristics of the pseudo-boehmite layer will vary depending upon the type of the binder. In general, the larger the amount of the binder, the smaller the average pore radius.

As the binder, it is usually possible to employ an organic material such as starch or one of its modified products, poly(vinyl alcohol) or one of its modified products, SBR latex, NBR latex, cellulose derivatives, quaternary ammonium salt polymers, poly(phosphazenes), etheric substituted acrylates, poly(vinyl pyrrolidone) or other suitable binders. The binder is used in an amount of from 5 to 75 percent by weight of the pseudo-boehmite, preferably in an amount of 5 to 50 percent by weight of the pseudo-boehmite. If the amount of binder is less than 5 percent by weight, the strength of the aluminum hydrate layer tends to be inadequate. On the other hand, if it exceeds 75 percent by weight, the waterfastness of the layer is adversely affected.

As a method of forming the pseudo-boehmite layer on the solvent-absorbing lower layer, it is possible to employ, for example, a method wherein a binder is added to a boehmite sol to obtain a slurry and the slurry is coated over the solvent-absorbent lower layer by means of a roll coater, an air knife coater, a blade coater, a rod coater, a bar coater, a comma coater, or the like and dried.

In the present invention, when the ink is ejected from the nozzle of the ink-jet printer in the form of individual droplets, the droplets pass through the upper layer of porous pseudo-boehmite where most of the dyes in the ink are retained or mordanted in the pseudo-boehmite layer while the remaining dyes and the solvent or carrier portion of the ink pass freely through the pseudo-boehmite layer to the solvent-absorbing layer where they are rapidly absorbed by the microporous material. In this manner, large volumes of ink are quickly absorbed by the recording elements of the present invention giving rise to high quality recorded images having excellent optical density and good color gaumet.

The image-forming layers used in the recording elements of the present invention also can incorporate various known additives, including matting agents such as titanium dioxide, zinc oxide, silica and polymeric beads such as crosslinked poly(methyl methacrylate) or polystyrene beads for the purposes of contributing to the non-blocking characteristics of the recording elements used in the present invention and to control the smudge resistance thereof; surfactants such as non-ionic, hydrocarbon or fluorocarbon surfactants or cationic surfactants, such as quaternary ammonium salts for the purpose of improving the aging behavior of the ink-absorbent resin or layer, promoting the absorption and drying of a subsequently applied ink thereto, enhancing the surface uniformity of the ink-receiving layer and adjusting the surface tension of the died coating; fluorescent dyes; pH controllers; anti-foaming agents; lubricants; preservatives; viscosity modifiers; dye-fixing agents; waterproofing agents; dispersing agents; UV absorbing agents; mildew-proofing agents; mordants; antistatic agents, and the like. Such additives can be selected from known compounds or materials in accordance with the objects to be achieved.

If desired, the recording elements of the present invention can have the pseudo-boehmite layer overcoated with an ink-permeable, anti-tack protective layer, such as, for example, a layer comprising a cellulose derivative such as hydroxymethyl cellulose, hydroxyethyl cellulose, hydroxypropyl methyl cellulose and carboxymethyl cellulose. An especially preferred topcoat is hydroxypropyl methyl cellulose. Such cellulosic resins are commercially available. For example, hydroxypropyl methyl cellulose can be obtained from Dow Chemical Corporation under the tradename Methocel™. The topcoat layer is non-porous, but is ink-permeable. It serves to improve the optical density of images printed on the element with water-based inks and reduces the tackiness of the recording face of the element. The topcoat layer also serves to protect the porous pseudo-boehmite layer from abrasion, smudging and water damage.

The topcoat material preferably is coated onto the pseudo-boehmite layer from water or water-methanol solutions at a dry thickness ranging from 0.1 to 5.0 micrometers, preferably 0.5 to 2.0 micrometers. The topcoat layer may be coated in a separate operation or may be coated concurrently with the pseudo-boehmite layer using a multi-slot hopper or a slide-hopper.

In practice, various additives may be employed in the topcoat. These additives include surface active agents which control the wetting or spreading action of the coating mixture, antistatic agents, suspending agents, particulates which control the frictional properties or act as spacers for the coated product, antioxidants, UV-stabilizers and the like.

The inks used to image the recording elements used in the present invention are well-known inks. The ink compositions used in ink-jet printing typically are liquid compositions comprising a solvent or carrier liquid, dyes or pigments, humectants, organic solvents, detergents, thickeners, preservatives, and the like. The solvent or carrier liquid can be comprised solely of water or can be predominantly water mixed with other water miscible solvents such as polyhydric alcohols, although inks in which organic materials such as polyhydric alcohols are the predominant carrier or solvent liquid also may be used. Particularly useful are mixed solvents of water and polyhydric alcohols. The dyes used in such compositions are typically water-soluble direct or acid type dyes. Such liquid ink compositions have been described extensively in the prior art including for example, U.S. Pat. Nos. 4,381,946; 4,239,543 and 4,781,758.

Although the recording elements disclosed here have been referred to as being useful for ink-jet printers, they also can be used as recording media for pen plotter assemblies. Pen plotters operate by writing directly on the surface of a recording medium using a pen consisting of a bundle of capillary tubes in contact with an ink reservoir.

The invention is further illustrated by reference to the following Examples. However, it should be understood that the present invention is by no means restricted to such specific Examples.

EXAMPLE 1

A recording element of the present invention was prepared according to the following procedure. A 7 mil layer of a microporous material obtained from PPG Industries, Inc., Pittsburg, Pa., identified as Teslin™Grade Sp700 was extrusion laminated with pigmented polyethylene onto a paper stock substrate that was 137 micrometers in thickness and made from a 1:1 blend of Pontiac Maple 51 (a bleached maple hardwood Kraft of 0.5 micrometer length weighted average fiber length obtained from Consolidated Pontiac, Inc.), and Alpha Hardwood Sulfite (a bleached red-alder hardwood sulfite of 0.69 micrometer average fiber length obtained from Weyerhauser Company). The pigmented polyethylene (12g/m$^2$ dried thickness) contained 12.5 percent by weight anatase titanium dioxide and 0.05 percent by weight benzoxazole optical brightener. The backside of the paper was coated with a high density polyethylene (30g/m$^2$ dried thickness).

An image-forming coating composition was then prepared as follows.

Into a 5 L, 3 neck Morton type flask fitted with a mechanical stirrer and a condenser were charged isopropanol (620 g; 764 mL) and water (2160 mL). The reaction mixture was heated to reflux (81° C.) while stirring (250 rpm). Aluminum isopropoxide (615 g; 3 mol) was added to the flask over a 45 minute period of time and heating at reflux was continued for 5 hours. Nitric acid (19.5 mL of 70.5%) was added dropwise to the flask over a 15 minute period of time. The stirred reaction mixture was maintained at reflux for 48 hours and 1280 mL of a water/isopropoxide azeotrope was distilled off. The reaction mixture was allowed to cool overnight and filtered to yield a 10 percent by weight dispersion of alumina sol.

A slurry was formed by adding 600 g of the alumina sol prepared as described above, a 10 percent solution of 600 g of poly (vinyl pyrrolidone) in water obtained from ISP Technologies, Inc., as PVP K-90, 144 g of nitric acid, 4.1 g of nonylphenoxypolyglycidol surfactant (20 percent solution in water) obtained from Olin Matheson Company as Surfactant 10G and 600 g of water. The slurry was coated on the solvent-absorbing Teslin™ layer using an extrusion hopper and dried to form a porous, pseudo-boehmite layer 0.6 g/ft.$^2$ in thickness (dried thickness) covering the solvent-absorbing layer.

EXAMPLE 2

A recording element of the invention was prepared according to the procedure of Example 1 except that uncoated paper was used as the substrate instead of coated paper.

EXAMPLE 3

A recording element of the invention was prepared according to the procedure of Example 1 except that a silica containing micro-voided polyethylene terephthalate film was used as the substrate instead of coated paper.

EXAMPLE 4

A recording element of the invention was prepared according to the procedure of Example 1 except that a polyethylene terephthalate film was used as the substrate instead of coated paper.

EXAMPLE 5

A recording element of the invention was prepared according to the procedure of Example 1 except that acetic acid was used instead of nitric acid to make the porous, pseudo-boehmite and the porous, pseudo-boehmite layer was overcoated with a solution containing 29.5 g of Methocel™ KLV 100 (hydroxypropyl methyl cellulose) obtained from Dow Chemical Corporation, 970 g of water, 0.5 g of vanadyl sulfate-2-hydrate crystals (95 percent) obtained from Eastman Fine Chemicals and 0.5 g of Surfactant 10G (nonylphenoxypolyglycidol; 20 percent solution in water) obtained from Olin Matheson Company at a dry laydown coverage of 0.2 g/$ft_2$.

EXAMPLE 6

A recording element of the prior art was prepared consisting only of a layer of Teslin™ (7 mils thickness) as an imaging-forming surface extrusion laminated with pigmented polyethylene onto a paper substrate.

Images were formed on the recording elements prepared as described in Examples 1–6, above using a Hewlett-Packaged Desk Writer 560C 4-Color Ink-Jet Printer and a Cannon BJC-4000 4-Color Ink-Jet Printer. The images comprised a series of cyan, magenta, yellow and black patches, each patch being in the form of a rectangle 1.5 inches (0.59 cm) in length and 0.5 inch (0.19 cm) in width.

The optical densities of the imaged areas on the recording elements of Examples 1–6 were measured using an X-Rite Photographic Densitometer. A densitometer is an optical instrument used to measure the lightness or darkness of an image. Its measured output, called optical density, is based on the logarithm of the optical reflectance of the image and correlates well with visually perceived lightness or darkness. The results of the optical densities of the imaged areas printed on the recording elements of Examples 1–6 are shown in Table 1, below.

TABLE 1

| Printer | Sample | Dmin | Black | Yellow | Magenta | Cyan |
|---|---|---|---|---|---|---|
| HP560C | Example 1 | 0.06 | 1.77 | 1.17 | 1.25 | 1.88 |
| BJC-4000 | Example 1 | 0.06 | 1.74 | 0.76 | 1.16 | 1.56 |
| HP 560C | Example 2 | 0.06 | 1.82 | 1.19 | 1.23 | 1.93 |
| BJC-4000 | Example 2 | 0.05 | 1.95 | 0.71 | 1.14 | 1.59 |
| HP 560C | Example 3 | 0.06 | 1.64 | 1.02 | 1.21 | 1.82 |
| BJC-4000 | Example 3 | 0.06 | 1.77 | 0.85 | 1.43 | 1.74 |
| HP 560 | Example 4 | 0.06 | 1.79 | 1.1 | 1.24 | 1.91 |
| BJC-4000 | Example 4 | 0.06 | 1.79 | 0.91 | 1.47 | 1.82 |
| HP560C | Example 5 | 0.05 | 2.72 | 1.12 | 1.38 | 1.67 |
| BJC-4000 | Example 5 | 0.05 | 1.94 | 1.07 | 1.21 | 1.34 |
| HP560C | Example 6 | 0.06 | 0.88 | 0.58 | 0.72 | 0.96 |
| BJC-4000 | Example 6 | 0.06 | 0.87 | 0.5 | 0.74 | 1.07 |

The results in Table 1 show that the recording elements of the present invention, when imaged with an ink-printing device, produce images that have higher optical densities than the comparative prior art element consisting of a layer of microporous material (e.g., Teslin™) when imaged directly with an ink-jet printer.

Although the invention has been described in detail with reference to certain preferred embodiments for the purpose of illustration, it is to be understood that variations and modifications can be made by those skilled in the art without departing from the spirit and scope of the invention.

We claim:

1. An opaque image-recording element for an ink-jet printer which comprises an opaque support having on at least one surface thereof a lower layer of a solvent-absorbing microporous material comprising:

(a) a matrix of substantially water-insoluble thermoplastic organic polymer;

(b) finely divided substantially water-insoluble filler particles, of which at least 50 percent by weight are siliceous particles, said filler particles being distributed throughout said matrix and constituting from 40 to 90 percent by weight of said microporous material;

(c) a network of interconnecting pores communicating substantially throughout said microporous material, said pores constituting from 35 to 95 percent by volume of said microporous material, and an upper image-forming layer of porous pseudo-boehmite having an average pore radius of from 10 to 80 Å.

2. An image-recording element of claim 1, wherein said substantially water-insoluble thermoplastic organic polymer comprises essentially linear ultrahigh molecular weight polyolefin selected from the group consisting of essentially linear ultrahigh molecular weight polyethylene having an intrinsic viscosity of at least 10 deciliters/gram, essentially linear ultrahigh molecular weight polypropylene having an intrinsic viscosity of at least 6 deciliters/gram, and mixtures thereof.

3. An image-recording element of claim 2, wherein said essentially linear ultrahigh molecular weight polyolefin is essentially linear ultrahigh molecular weight polyethylene having an intrinsic viscosity of at least 18 deciliters/gram.

4. An image-recording element of claim 3, wherein said filler particles constitute from 40 percent to 85 percent by weight of said microporous material.

5. An image-recording element of claim 3, wherein said siliceous particles of said microporous material are silica particles.

6. An image-recording element of claim 3, wherein said siliceous particles of said microporous material are precipitated silica particles.

7. An image-recording element of claim 6, wherein said precipitated silica particles have an average ultimate particle size of less than about 0.1 micrometer.

8. An image-recording element of claim 1, wherein the porous pseudo-boehmite layer has an average pore radius of 15 to 60 Å.

9. An image-recording element of claim 1, wherein the porous pseudo-boehmite layer has a pore volume of 0.1 to 2.0 cc/g.

10. An image-recording element of claim 1, wherein the thickness of said substrate is 50 to 500 micrometers.

11. An image-recording element of claim 1, wherein the dry thickness of said porous pseudo-boehmite layer is from 0.1 to 20 micrometers.

12. An image-recording element of claim 1, wherein the dry thickness of said solvent-absorbing layer is 1.0 to 18 mils.

13. An image-recording element of claim 1, further comprising an ink-permeable protective layer for said image-forming layer.

14. An image-recording element of claim 13 wherein said protective layer is hydroxypropyl methyl cellulose.

15. An image-recording element of claim 13, wherein the dry thickness of said protective layer is from 0.1 to 5.0 micrometers.

16. An image-recording element of claim 1, further comprising at least one priming layer between said substrate and said microporous layer.

17. A printing process which comprises applying liquid ink droplets to an image-recording element of claim 1.

* * * * *